US008975994B2

(12) United States Patent
Hansen et al.

(10) Patent No.: US 8,975,994 B2
(45) Date of Patent: Mar. 10, 2015

(54) INDUCTOR WITH THERMALLY STABLE RESISTANCE

(71) Applicant: Vishay Dale Electronics, Inc., Columbus, NE (US)

(72) Inventors: Thomas T. Hansen, Yankton, SD (US); Jerome J. Hoffman, Yankton, SD (US); Timothy Schafer, Yankton, SD (US); Nicholas J. Schade, Yankton, SD (US); David Lange, Columbus, NE (US); Clark Smith, Columbus, NE (US); Rod Brune, Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 0 days.

(21) Appl. No.: 13/768,039

(22) Filed: Feb. 15, 2013

(65) Prior Publication Data

US 2013/0285784 A1 Oct. 31, 2013

Related U.S. Application Data

(63) Continuation of application No. 13/198,274, filed on Aug. 4, 2011, now Pat. No. 8,378,772, which is a continuation of application No. 11/535,758, filed on Sep. 27, 2006, now Pat. No. 8,018,310.

(51) Int. Cl.
*H01F 27/30* (2006.01)

(52) U.S. Cl.
USPC ..... 336/192

(58) Field of Classification Search
USPC ..... 336/178, 233–234, 200, 192
See application file for complete search history.

(56) References Cited

U.S. PATENT DOCUMENTS

| | | | | |
|---|---|---|---|---|
| 4,719,433 | A | 1/1988 | Hackel et al. | |
| 5,287,083 | A | 2/1994 | Person et al. | |
| 6,204,744 | B1 | 3/2001 | Shafer et al. | |
| 6,356,179 | B1 | 3/2002 | Yamada | |
| 6,417,753 | B1 * | 7/2002 | Wolf et al. | 336/182 |

(Continued)

FOREIGN PATENT DOCUMENTS

| | | |
|---|---|---|
| DE | 201 17 650 U1 | 3/2003 |
| JP | 58-63731 U | 4/1983 |

(Continued)

OTHER PUBLICATIONS

PCT International Search Report from Corresponding Application PCT/US2006/039731.

*Primary Examiner* — Tuyen Nguyen
(74) *Attorney, Agent, or Firm* — Volpe and Koenig, P.C.

(57) ABSTRACT

An inductor includes an inductor body having a top surface and a first and second opposite end surfaces. There is a void through the inductor body between the first and second opposite end surfaces. A thermally stable resistive element positioned through the void and turned toward the top surface to forms surface mount terminals which can be used for Kelvin type sensing. Where the inductor body is formed of a ferrite, the inductor body includes a slot. The resistive element may be formed of a punched resistive strip and provide for a partial turn or multiple turns. The inductor may be formed of a distributed gap magnetic material formed around the resistive element. A method for manufacturing the inductor includes positioning an inductor body around a thermally stable resistive element such that terminals of the thermally stable resistive element extend from the inductor body.

4 Claims, 4 Drawing Sheets

(56) References Cited

U.S. PATENT DOCUMENTS

| | | | | |
|---|---|---|---|---|
| 6,759,935 | B2 | 7/2004 | Moro et al. | |
| 6,946,944 | B2 | 9/2005 | Shafer et al. | |
| 6,967,553 | B2 * | 11/2005 | Jitaru | 336/178 |
| 7,280,025 | B2 | 10/2007 | Sano | |
| 7,471,181 | B1 * | 12/2008 | MacLennan | 336/229 |
| 2002/0113680 | A1 * | 8/2002 | Kato et al. | 336/83 |
| 2006/0049907 | A1 | 3/2006 | Liu | |
| 2006/0089022 | A1 | 4/2006 | Sano | |

FOREIGN PATENT DOCUMENTS

| | | | |
|---|---|---|---|
| JP | 4 024908 | A | 1/1992 |
| JP | 6-26229 | U | 4/1994 |
| JP | 7-235427 | A | 5/1995 |
| JP | 2000-133501 | A | 5/2000 |
| JP | 2001-267160 | A | 9/2001 |
| JP | 2005-353337 | A | 12/2005 |
| JP | 2006-112868 | A | 4/2006 |
| JP | 2006-131462 | A | 5/2006 |
| WO | 99/19889 | A1 | 4/1999 |

* cited by examiner

INDUCTOR WITH THERMALLY STABLE RESISTANCE

CROSS REFERENCE TO RELATED APPLICATIONS

This application is a continuation of U.S. patent application Ser. No. 13/198,274, filed Aug. 4, 2011, issuing as U.S. Pat. No. 8,378,772 on Feb. 19, 2013, which is a continuation of U.S. patent application Ser. No. 11/535,758, filed Sep. 27, 2006, now U.S. Pat. No. 8,018,310, issued Sep. 13, 2011, the entire contents of all of which are hereby incorporated by reference as if fully set forth herein.

BACKGROUND

Inductors have long been used as energy storage devices in non-isolated DC/DC converters. High current, thermally stable resistors also have been used concurrently for current sensing, but with an associated voltage drop and power loss decreasing the overall efficiency of the DC/DC converter. Increasingly, DC/DC converter manufacturers are being squeezed out of PC board real estate with the push for smaller, faster and more complex systems. With shrinking available space comes the need to reduce part count, but with increasing power demands and higher currents comes elevated operating temperatures. Thus, there would appear to be competing needs in the design of an inductor.

Combining the inductor with the current sense resistor into a single unit would provide this reduction in part count and reduce the power loss associated with the DCR of the inductor leaving only the power loss associated with the resistive element. While inductors can be designed with a DCR tolerance of ±15% or better, the current sensing abilities of its resistance still vary significantly due to the 3900 ppm/° C. Thermal Coefficient of Resistance (TCR) of the copper in the inductor winding. If the DCR of an inductor is used for the current sense function, this usually requires some form of compensating circuitry to maintain a stable current sense point defeating the component reduction goal. In addition, although the compensation circuitry may be in close proximity to the inductor, it is still external to the inductor and cannot respond quickly to the change in conductor heating as the current load through the inductor changes. Thus, there is a lag in the compensation circuitry's ability to accurately track the voltage drop across the inductor's winding introducing error into the current sense capability. To solve the above problem an inductor with a winding resistance having improved temperature stability is needed.

SUMMARY

Therefore, it is a primary object, feature, or advantage of the present invention to improve over the state of the art.

It is a further object, feature, or advantage of the present invention to provide an inductor with a winding resistance having improved thermal stability.

It is another object, feature, or advantage of the present invention to combine an inductor with a current sense resistor into a single unit thereby reducing part count and reducing the power loss associated with the DCR of the inductor.

One or more of these and/or other objects, features, or advantages of the present invention will become apparent from the specification and claims that follow.

According to one aspect of the present invention an inductor is provided. The inductor includes an inductor body having a top surface and a first and second opposite end surfaces.

The inductor includes a void through the inductor body between the first and second opposite end surfaces. A thermally stable resistive element is positioned through the void and turned toward the top surface to form opposite surface mount terminals. The surface mount terminals may be Kelvin terminals for Kelvin-type measurements. Thus, for example, the opposite surface mount terminals are split allowing one part of the terminal to be used for carrying current and the other part of the terminal for sensing voltage drop.

According to another aspect of the present invention an inductor includes an inductor body having a top surface and a first and second opposite end surfaces, the inductor body forming a ferrite core. There is a void through the inductor body between the first and second opposite end surfaces. There is a slot in the top surface of the inductor body. A thermally stable resistive element is positioned through the void and turned toward the slot to form opposite surface mount terminals.

According to another aspect of the present invention, an inductor is provided. The inductor includes an inductor body having a top surface and a first and second opposite end surfaces. The inductor body formed of a distributed gap magnetic material such, but not limited to MPP, HI FLUX, SENDUST, or powdered iron. There is a void through the inductor body between the first and second opposite end surfaces. A thermally stable resistive element is positioned through the void and turned toward the top surface to form opposite surface mount terminals.

According to yet another aspect of the present invention an inductor is provided. The inductor includes a thermally stable resistive element and an inductor body having a top surface and a first and second opposite end surfaces. The inductor body includes a distributed gap magnetic material pressed over the thermally stable resistive elements.

According to another aspect of the present invention an inductor is provided. The inductor includes a thermally stable wirewound resistive element and an inductor body of a distributed gap magnetic material pressed around the thermally stable wirewound resistive element.

According to yet another aspect of the present invention, a method is provided. The method includes providing an inductor body having a top surface and a first and second opposite end surfaces, there being a void through the inductor body between the first and second opposite end surfaces and providing a thermally stable resistive element. The method further includes positioning the thermally stable resistive element through the void and turning ends of the thermally stable resistive element toward the top surface to form opposite surface mount terminals.

According to yet another aspect of the present invention there is a method of forming an inductor. The method includes providing an inductor body material; providing a thermally stable resistive element and positioning the inductor body around the thermally stable resistive element such that terminals of the thermally stable resistive element extend from the inductor body material.

DETAILED DESCRIPTION OF THE PREFERRED EMBODIMENTS

One aspect of the present invention provides a low profile, high current inductor with thermally stable resistance. Such an inductor uses a solid Nickel-chrome or Manganese-copper metal alloy or other suitable alloy as a resistive element with a low TCR inserted into a slotted ferrite core.

Figure 1:
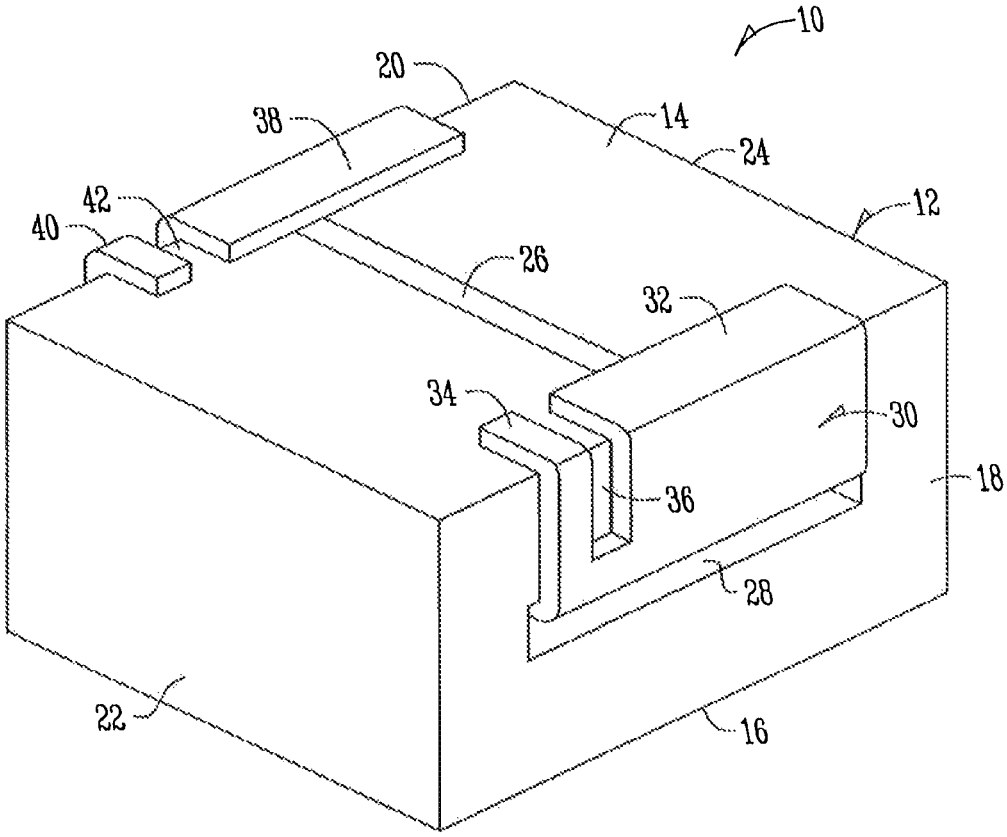
FIG. 1 is a perspective view illustrating one embodiment of an inductor having a partial turn through a slotted core.

FIG. 1 illustrates a perspective view of one such embodiment of the present invention. The device 10 includes an inductor body 12 have a top side 14, a bottom side 16, a first end 18, an opposite second end 20, and first and second opposite sides 22, 24. It is to be understood that the terms "top" and "bottom" are merely being used for orientation purposes with respect to the figures and such terminology may be reversed. The device 10, where used as a surface mount device, would be mounted on the slot side or top side 14. The inductor body 12 may be a single component, magnetic core such as may be formed from pressed magnetic powder. For example, the inductor body 12 may be a ferrite core. Core materials other than ferrite such as powdered iron or alloy cores may also be used. The inductor body 12 shown has a single slot 26. There is a hollow portion 28 through the inductor body 12. Different inductance values are achieved by varying core material composition, permeability or in the case of ferrite the width of the slot.

A resistive element 30 in a four terminal Kelvin configuration is shown. The resistive element 30 is thermally stable, consisting of thermally stable nickel-chrome or thermally stable manganese-copper or other thermally stable alloy in a Kelvin terminal configuration. As shown, there are two terminals 32, 34 on a first end and two terminals 38, 40 on a second end. A first slot 36 in the resistive element 30 separates the terminals 32, 34 on the first end of the resistive element 30 and a second slot 42 in the resistive element 30 separates the terminals 38, 40 on the second end of the resistive element 30. In one embodiment, the resistive element material is joined to copper terminals that are notched in such a way as to produce a four terminal Kelvin device for the resistive element 30. The smaller terminals 34, 40 or sense terminals are used to sense the voltage across the element to achieve current sensing, while the remaining wider terminals 32, 38 or current terminals are used for the primary current carrying portion of the circuit. The ends of the resistive element 30 are formed around the inductor body 12 to form surface mount terminals.

Although FIG. 1 shows a partial or fractional turn through a slotted polygonal ferrite core, numerous variations are within the scope of the invention. For example, multiple turns could be employed to provide greater inductance values and higher resistance. While prior art has utilized this style of core with a single two terminal conductor through it, the resistance of the copper conductor is thermally unstable and varies with self-heating and the changing ambient temperature due to the high TCR of the copper. To obtain accurate current sensing, these variations require the use of an external, stable current sense resistor adding to the component count with associated power losses. Preferably, a thermally stable nickel-chrome or manganese-copper resistive element or other thermally stable alloy is used. Examples of other materials for the thermally stable resistive element include various types of alloys, including non-ferrous metallic alloys. The resistive element may be formed of a copper nickel alloy, such as, but not limited to CUPRON. The resistive element may be formed of an iron, chromium, aluminum alloy, such as, but not limited to KANTHAL D. The resistive element preferably has a temperature coefficient significantly less than copper and preferably having a temperature coefficient of resistance (TCR) of .ltoreq.100 PPM/° C. at a sufficiently high Direct Current Resistance (DCR) to sense current. Furthermore, the element is calibrated by one or more of a variety of methods known to those skilled in the art to a resistance tolerance of ±1% as compared to a typical inductor resistance tolerance of ±20%.

Thus one aspect of the present invention provides two devices in one, an energy storage device and a very stable current sense resistor calibrated to a tight tolerance. The resistor portion of the device will preferably have the following characteristics: low Ohmic value (0.2 m'Ω to 1 'Ω), tight tolerance ±1%, a low TCR .ltoreq.100 PPM/° C. for −55 to 125° C. and low thermal electromotive force (EMF). The inductance of the device will range from 25 nH to 10 uH. But preferably be in the range of 50 nH to 500 nH and handle currents up to 35 A.

Figure 2:
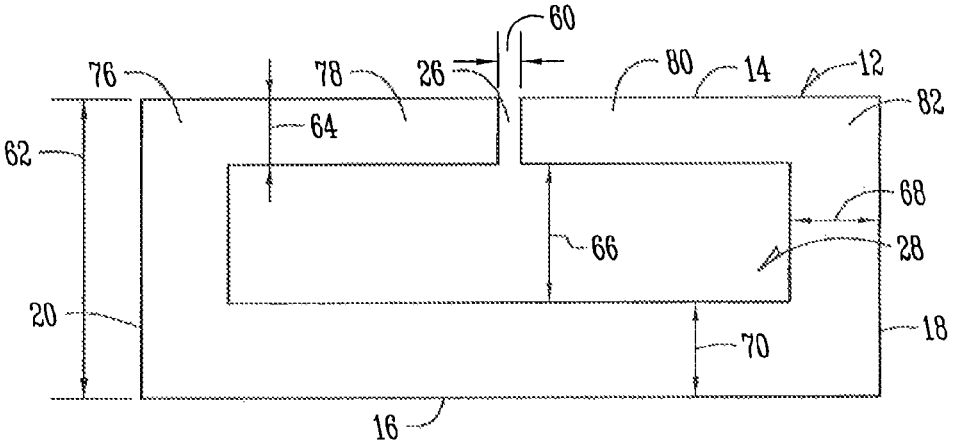
FIG. 2 is a cross-sectional view of a single slot ferrite core.

FIG. 2 is a cross-section of a single slot ferrite core. As shown in FIG. 2, the single slot ferrite core is used as the inductor body 12. The top side 14 and the bottom side 16 of the inductor body 12 are shown as well as the first end 18 and opposite second end 20. The single slot ferrite core has a height 62. A first top portion 78 of the inductor body 12 is separated from a second top portion 80 by the slot 60. Both the first top portion 78 and the second top portion 80 of the inductor body 12 have a height 64 between the top side 14 and the hollow portion or void 28. A bottom portion of the inductor body 12 has a height 70 between the hollow portion or void 28 and the bottom side 16. A first end portion 76 and a second end portion 82 have a thickness 68 from their respective end surfaces to the hollow portion or void 28. The hollow portion or void 28 has a height 66. The slot 26 has a width 60. The embodiment of FIG. 2 includes a polygonal ferrite core for the inductor body 12 with a slot 60 on one side and a hollow portion or void 28 through the center. A partial turn resistive element 30 is inserted in this hollow portion 28 to be used as a conductor. Varying the width of the slot 60 will determine the inductance of the part. Other magnetic materials and core configurations such as powdered iron, magnetic alloys or other magnetic materials could also be used in a variety of magnetic core configurations. However the use of a distributed gap magnetic material such as powdered iron would eliminate the need for a slot in the core. Where ferrite material is used, the ferrite material preferably conforms to the following minimum specifications:

1. Bsat>4800 G at 12.5 Oe measured at 20° C.
2. Bsa Minimum=4100 G at 12.5 Oe measured at 100° C.
3. Curie temperature, Tc>260° C.
4. Initial Permeability: 1000-2000

The top side 14, which is the slot side, will be the mounting surface of the device 10 where the device 10 is surface mounted. The ends of the resistive element 30 will bend around the body 12 to form surface mount terminals.

According to one aspect of the invention a thermally stable resistive element is used as its conductor. The element may be constructed from a nickel-chrome or manganese-copper strip formed by punching, etching or other machining techniques. Where such a strip is used, the strip is formed in such manner as to have four surface mount terminals (See e.g. FIG. 4). Although it may have just two terminals, the two or four terminal strip is calibrated to a resistance tolerance of ±1%. The nickel-chrome, manganese-copper or other low TCR alloy element allow for a temperature coefficient of ltoreq.100 ppm/° C. To reduce the effects of mounted resistance tolerance variations in lead resistance, TCR of copper terminals and solder joint resistance, a four terminal construction would be employed rather than two terminals. The two smaller terminals are typically used to sense the voltage across the resistive element for current sensing purposes while the larger terminals typically carry the circuit current to be sensed.

According to another aspect of the invention, the device 10 is constructed by inserting the thermally stable resistive element through the hollow portion of the inductor body 12. The resistor element terminals are bent around the inductor body to the top side or slot side to form surface mount terminals. Current through the inductor can then be applied to the larger terminals in a typical fashion associated with DC/DC converters. Current sensing can be accomplished by adding two printed circuit board (PCB) traces from the smaller sense terminals to the control IC current sense circuit to measure the voltage drop across the resistance of the inductor.

Figure 3:
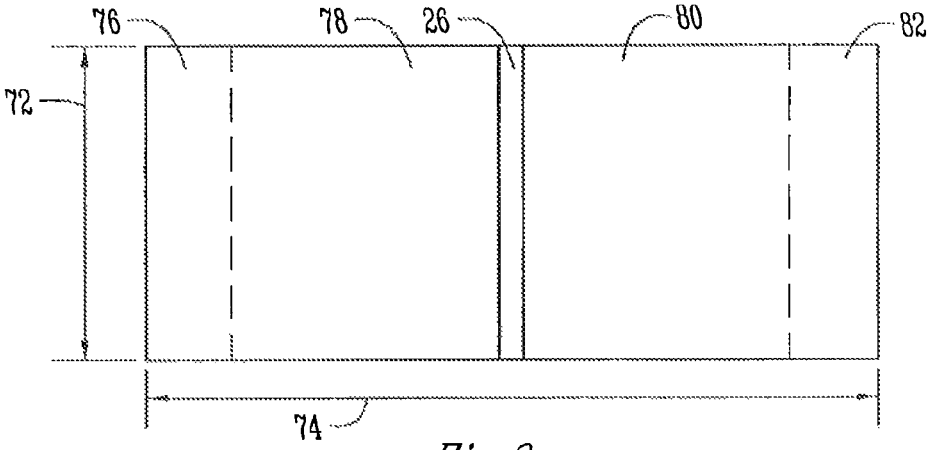
FIG. 3 is a top view of a single slot ferrite core.

FIG. 3 is a top view of a single slot ferrite core showing a width 74 and a length 72 of the inductor body 12.

Figure 4:
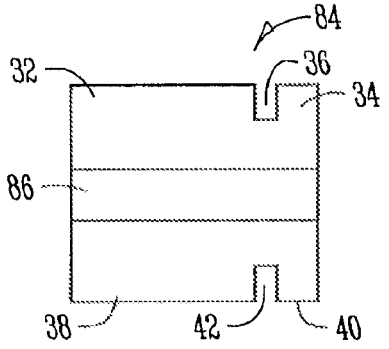
FIG. 4 is a top view of a strip having four surface mount terminals.

FIG. 4 is a top view of a strip 84 which can be used as a resistive element. The strip 84 includes four surface mount terminals. The strip 84 has a resistive portion 86 between terminal portions. Forming such a strip is known in the art and can be formed in the manner described in U.S. Patent No. 5,287,083, herein incorporated by reference in its entirety. Thus, here the terminals 32, 34, 38, 40 may be formed of copper or another conductor with the resistive portion 86 formed of a different material.

Figure 5:
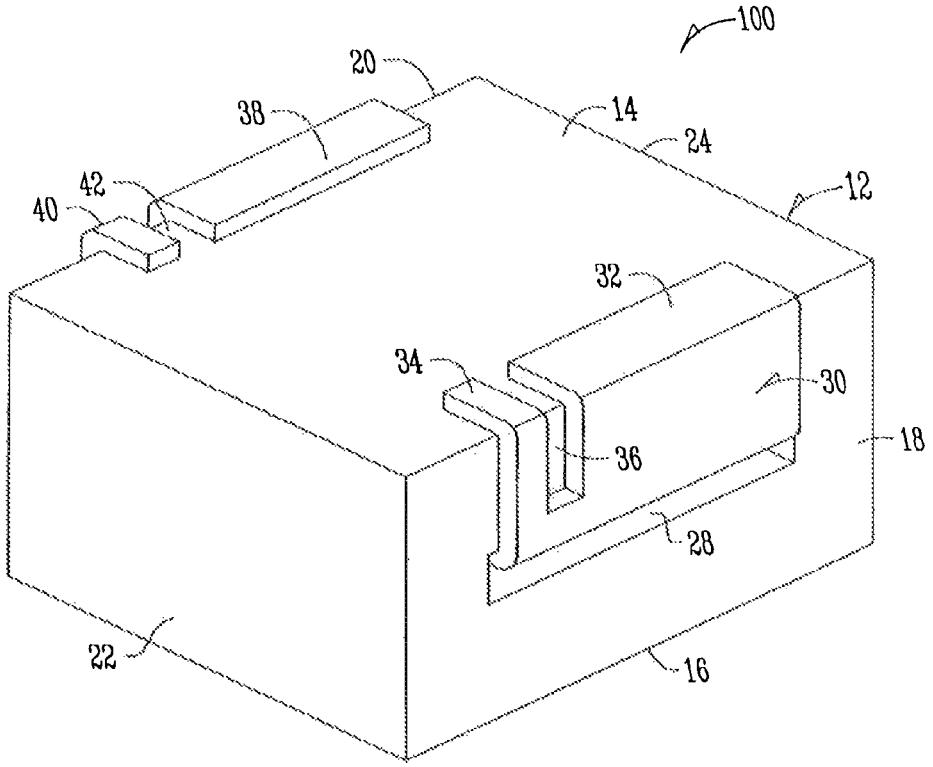
FIG. 5 is a perspective view illustrating one embodiment of an inductor without a slot.

FIG. 5 is a perspective view illustrating one embodiment of an inductor without a slot. The device 100 of FIG. 5 is similar to the device 10 of FIG. 1 except that the inductor body 12 is formed from a distributed gap material such as, but not limited to, a magnetic powder. In this embodiment, note that there is no slot needed due to the choice of material for the inductor body 12. Other magnetic materials and core configurations such as powdered iron, magnetic alloys or other magnetic materials can be used in a variety of magnetic core configurations. However the use of a distributed gap magnetic material such as powdered iron would eliminate the need for a slot in the core. Other examples of distributed gap magnetic materials include, without limitation, MPP, HI FLUX, and SENDUST.

Figure 6:
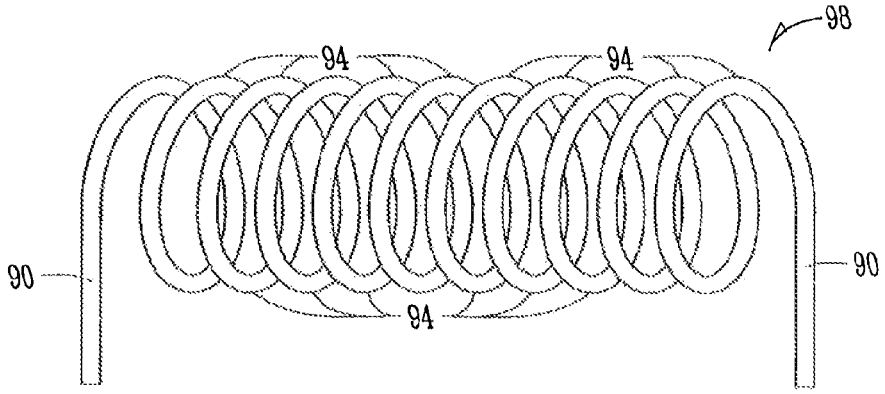
FIG. 6 is a view of one embodiment of a resistive element with multiple turns.

FIG. 6 is a view of one embodiment of a resistive element 98 with multiple turns 94 between ends 90. The present invention contemplates that the resistive element being used may include multiple turns to provide greater inductance values and higher resistance. The use of multiple turns to do so is known in the art, including, but not limited to, the manner described in U.S. Pat. No. 6,946,944, herein incorporated by reference in its entirety.

Figure 7:
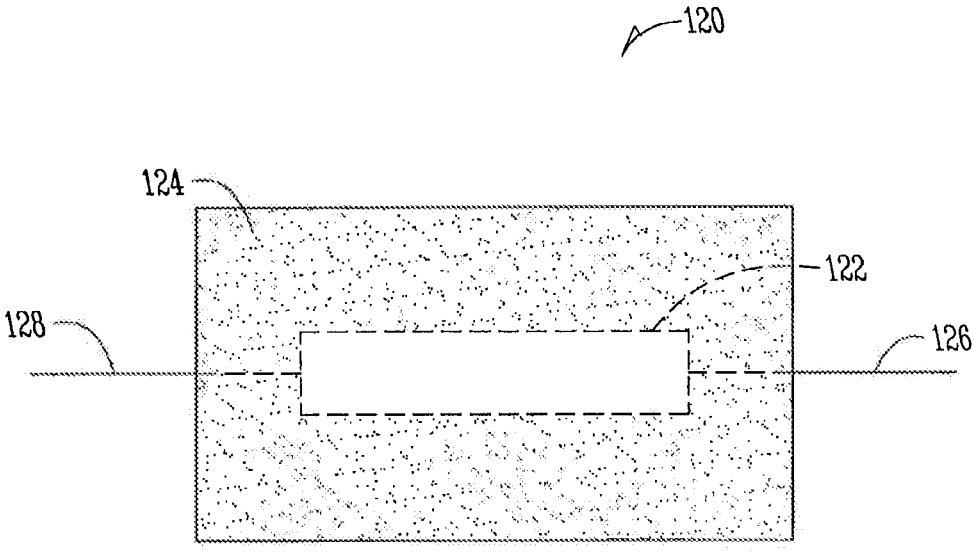
FIG. 7 is a view of one embodiment of the present invention where a wound wire resistive element is used.

FIG. 7 is a view of another embodiment. In FIG. 7, an inductor 120 is shown which includes a wound wire element 122 formed of a thermally stable resistive material wrapped around an insulator. A distributed gap magnetic material 124 is positioned around the wound wire element 122 such as through pressing, molding, casting or otherwise. The wound wire element 122 has terminals 126 and 128.

The resistive element used in various embodiments may be formed of various types of alloys, including non-ferrous metallic alloys. The resistive element may be formed of a copper nickel alloy, such as, but not limited to CUPRON. The resistive element may be formed of an iron, chromium, aluminum alloy, such as, but not limited to KANTHAL D. The resistive element may be formed through any number of processes, including chemical or mechanical, etching or machining or otherwise.

Thus, it should be apparent that the present invention provides for improved inductors and methods of manufacturing the same. The present invention contemplates numerous variations in the types of materials used, manufacturing techniques applied, and other variations which are within the spirit and scope of the invention.

What is claimed is:

1. An inductor comprising:

a thermally stable resistive element;

an inductor body having a top surface and first and second opposite end surfaces;

the inductor body comprising a distributed gap magnetic material pressed over the thermally stable resistive element;

wherein opposite ends of the resistive element are each turned along outer sides of the first and second opposite end surfaces toward the top surface of the inductor body and have ends that overlap the top surface of the inductor body to form opposite surface mount terminals, each surface mount terminal including a larger terminal for current carrying and a smaller terminal for Kelvin-type current sensing.

2. The inductor of claim 1 wherein the thermally stable resistive element is formed of a non-ferrous metallic alloy.

3. The inductor of claim 1 wherein the thermally stable resistive element comprises a non-ferrous metallic alloy comprising nickel and copper.

4. The inductor of claim 1 wherein the thermally stable resistive element comprises iron, chromium, and aluminum.

* * * * *